United States Patent [19]

Lucas

[11] 4,346,926

[45] Aug. 31, 1982

[54] DOOR SECURITY DEVICE

[76] Inventor: Frank E. Lucas, 121 Park Plaza Dr., Daly City, Calif. 94015

[21] Appl. No.: 284,418

[22] Filed: Jul. 20, 1981

[51] Int. Cl.[3] ..... E05F 5/14

[52] U.S. Cl. ..... 292/338

[58] Field of Search ..... 292/202, 338, 339, 259, 292/DIG. 15, DIG. 9, 262; 248/240.4

[56] References Cited

U.S. PATENT DOCUMENTS

| | | | |
|---|---|---|---|
| 384,715 | 6/1888 | Reisse | 292/338 |
| 1,002,812 | 9/1911 | Moore | 292/338 |
| 1,606,084 | 11/1926 | Kline | 292/338 |
| 1,918,129 | 7/1933 | Phillips | 292/338 |
| 2,760,806 | 8/1956 | Woodard et al. | 292/338 |
| 4,176,870 | 12/1979 | Cracraft | 292/338 |

*Primary Examiner*—Richard E. Moore

[57] ABSTRACT

A door security device for preventing opening from the outside of a hinged door adjacent and normal to a wall wherein an elongate support rod has its opposite ends rotatably connected by hinges to the door. An elongate stop rod is rigidly secured at one end to the support rod at an acute angle and is adapted at its free end to engage the wall. A spacing rod is rigidly secured at its first end to the support rod and is rigidly secured at its other end to the stop rod. The door security device allows unrestricted opening of the door from either side of the door when the device is rotated to lie in a plane parallel to the door. When the device is rotated about the axis of the support rod to lie in a plane normal to the door, opening of the door from the outside is prevented by the force of the free end of the stop rod against the wall and the force against the door of the end of the support rod to which the stop rod is secured.

9 Claims, 6 Drawing Figures

DOOR SECURITY DEVICE

This invention relates generally to home security devices, and more specifically to devices for securing doors from unauthorized outside entry.

BACKGROUND OF THE INVENTION

Doors are means for controlling entry. Whether one desires to keep out insects or to keep out burglars, doors are designed with the object of providing one with means for selectively controlling passage through one's portals.

Throughout the ages a multitude of devices have been designed to close doors to the unwanted. This search for security has traveled from the moats and drawbridges of the Middle Ages to the ubiquitous chain latch of modern apartments. With the recent increase in crime, most notably of burglaries, homeowners have renewed the search for a device with which to safely secure their homes from unwanted intruders. Chain latches and other edge mounted latches and bolts have proved far too susceptible to the shear forces that are generated between the door frame and the edge of the door itself when strong force is applied to the outside of the door. The failure mode for these devices is generally the uprooting of support screws or the like as a result of these shear forces.

Deadbolts and other locks mounted in the core of the door are susceptible to tampering via devices inserted into the crevice between the door and the door frame. Also, these locks require a hollow void in the core of the door which weakens the strength of the door itself. Therefore, repeated blows or kicks will often cause doors secured by such devices to splinter and fracture in the vicinity of the device.

The need has been recognized for a device which is specifically designed to resist failure from the extreme forces which may easily be generated on the outside of the door by an intruder. The mechanism of the present invention channels these factors from the door to an adjacent wall.

Woodard et al., U.S. Pat. No. 2,760,806 discloses a device for limiting, rather than preventing, opening movement of a door. While this device can be said to redirect force from outside the door to an adjacent wall, its purpose is to keep out insects, not burglars. Thus, this device permits opening of the door to an arc of ninety degrees. Further opening is only prevented so that a spring attached to the door will have enough leverage to be able to automatically swing the door closed. For this reason, the Woodard-type device is designed for use with a door which is mounted parallel to an adjacent wall. The device automatically engages the adjacent wall every time the door is swung open ninety degrees. Thus, it provides no means for completely preventing opening the door from the outside. No means for selectively engaging or disengaging the device are required or included since access to the room is always available from either side of the door. Separate means for selectively barring access to the room from the outside world would always be required in a door equipped with the Woodard-type device.

SUMMARY OF THE INVENTION

The present invention provides a device for preventing intrusion into buildings by securing doors in a manner that is far less susceptible to the failure modes characteristic of the prior art.

A rigid stop rod is adapted to engage a wall normal to the door that is desired to be secured. The stop rod is connected to a support rod which is provided with a hinge attachment to the door. One or more spacing rods can be utilized to reinforce the connection between the stop rod and the support rod.

The device of this invention is intended to be operable by a person located inside the door, by the rotation of the stop rod to lie in a position flat against the plane of the door (generally vertical) whereby unrestricted egress and ingress is allowed through the doorway. Such a storage position can be either above or below the axis of rotation. However, for simplicity of explanation, the following description will be specific to positioning above the axis of rotation. When it is desired to prevent ingress, the stop rod is constructed to be rotated to lie in a plane perpendicular to the plane of the door. The stop rod then engages the wall which lies adjacent and normal to the door, preventing the door from being opened from the outside. From the engaged position, the device may be rotated only from the inside of the door to the unengaged position so that the door may always be opened from the inside.

In what presently constitutes the preferred embodiment, the door security device is rotated about hinges screwed to the door. The length of the stop rod is either constructed to extend, or is adjustable so that it extends, from about one to four inches shorter than the distance from the door to the wall, measured along the line of the stop rod, when the door security device is engaged in the position perpendicular to the door. By providing a stop rod of lesser length than necessary to maintain the door fully closed, the door can be placed ajar to a slight degree, in the manner of chain latches, to enable the operator to answer a knock on the door and view the caller without disengaging the door security device.

An advantage of this device is that any force applied to the door when the security device is engaged is transmitted from the door to the wall by means of the rigid stop rod. Very little, if any, shear strain is generated on the screws securing the device to the door. Therefore, extreme forces may be resisted, depending only on the strength of the door and the strength of the wall. Obviously, reinforcing pressure plates can be added to the door and the wall to distribute the applied forces and make the device virtually impervious to blows.

Another embodiment of the device of the present invention has a pressure plate mounted to the free end of the stop rod to distribute pressure from the stop rod to the wall in a manner which both increases reliability and reduces the possibility of scarring or marring the surface of the wall in normal operation.

In the preferred embodiment of the invention, an additional curved reinforcing member extends from the pressure plate, along the top rod and the spacing rod, to the support rod to further maximize resistance to breakage.

Another advantage of the present invention is that it can be mounted so that the stop rod engages the wall without the door first being placed ajar. In this embodiment, an intruder is prevented from attempting to cause breakdown of the device by repeatedly opening and closing the door to cause the device to hammer repeatedly against the wall. In this embodiment there also would be no opportunity for a burglar to reach through the opening when the door is ajar in order to attempt to disengage the doorstop with sophisticated burglar tools.

In still another embodiment of the present invention, a cover is provided on the hinge nearest the gap to further minimize the possibility of outside tampering.

In still another embodiment of the present invention, a restraining lip is provided on one hinge to releasably engage and hold the device in a position perpendicular to the plane of the door.

For a further understanding of the nature and advantages of the present invention, reference should be had to the following detailed description and accompanying drawings.

DETAILED DESCRIPTION OF THE INVENTION

Figure 1:
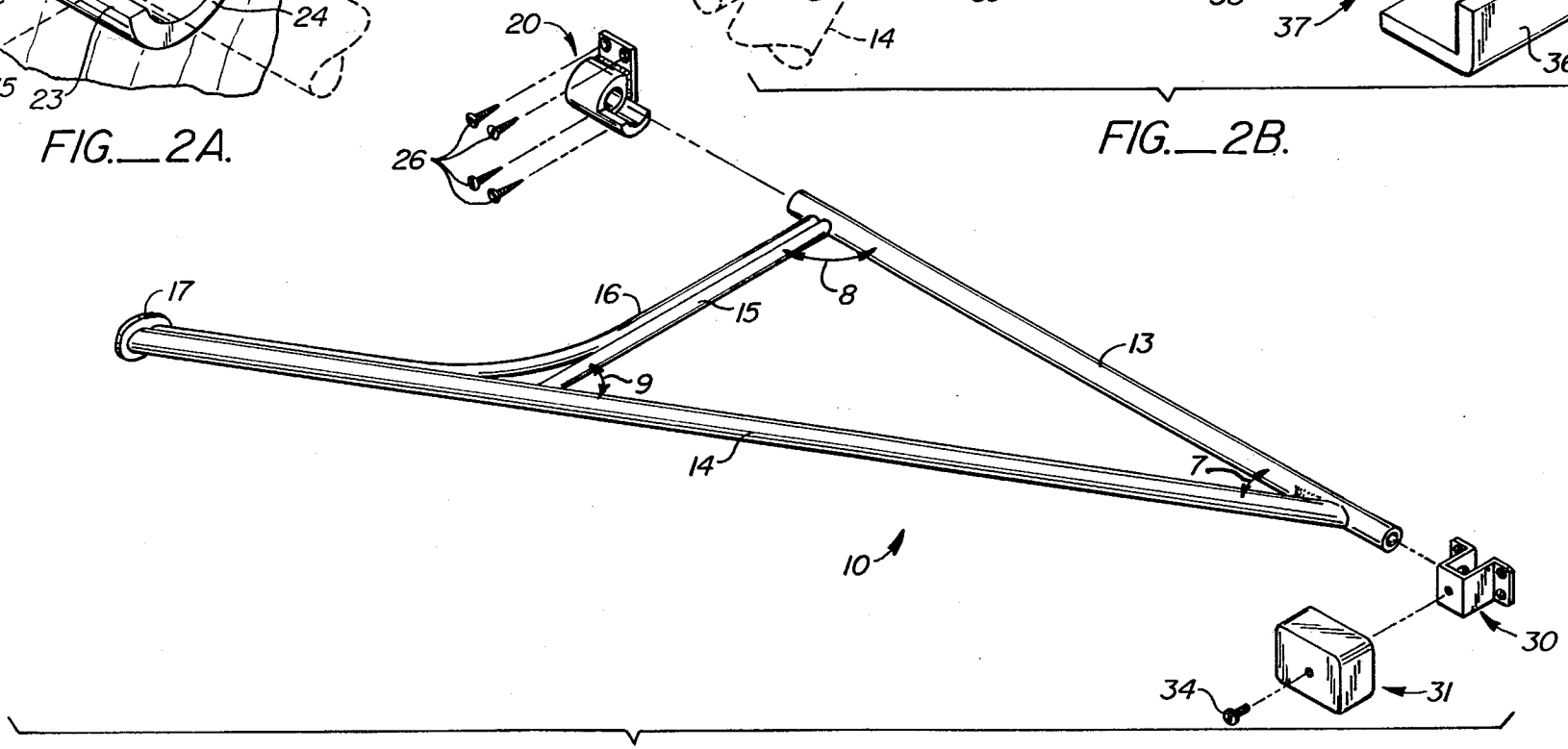
FIG. 1 is an exploded perspective view of the preferred embodiment of the present invention.

FIG. 1 is an exploded perspective view of the preferred embodiment of a door security device 10. An elongate stop rod 14 has one end rigidly secured to a support rod 13 at an acute angle 7 near the first end of the support rod 13. A spacing rod 15 and a reinforcing member 16 are rigidly secured to each other and to the support rod 13 at a right angle 8. The opposite end of the elongate spacing rod 15 is rigidly secured to the stop rod 14 at an acute angle 9 at a point somewhere between the ends of the stop rod 14. The rods 13, 14 and 15 form a triangle between their points of connection. The arcuate reinforcing member 16 is rigidly secured along its lower portion to the spacing rod 15 and is rigidly secured along its upper portion to the stop rod 14. The end of the upper portion of the reinforcing member 16 and the free end of the stop rod 14 are rigidly secured to an ovoid pressure plate 17.

Figure 3:
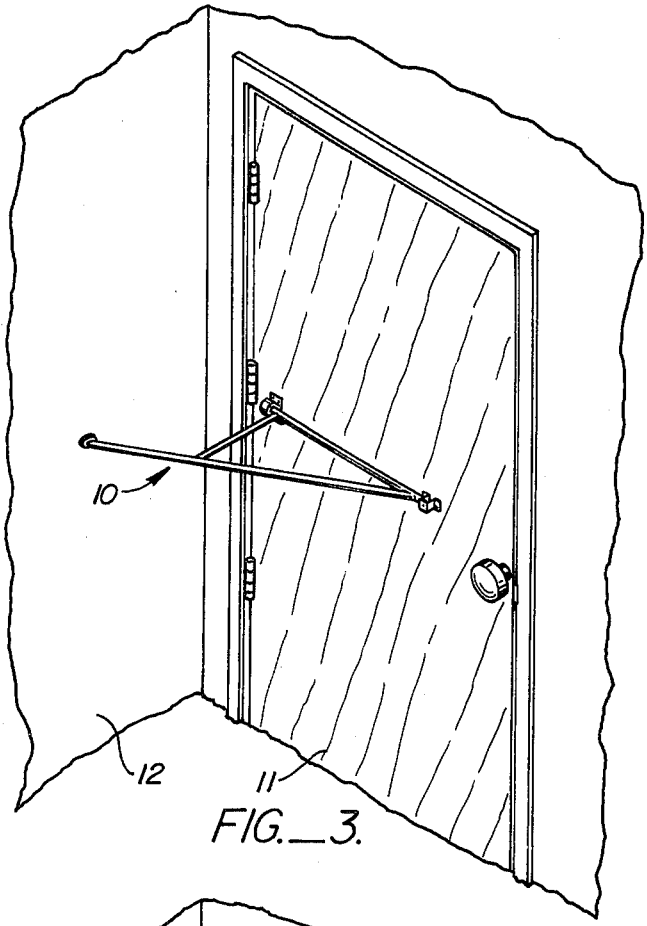
FIG. 3 is a perspective view of an embodiment of the present invention which prevents all opening movement of the door.
Figure 4:
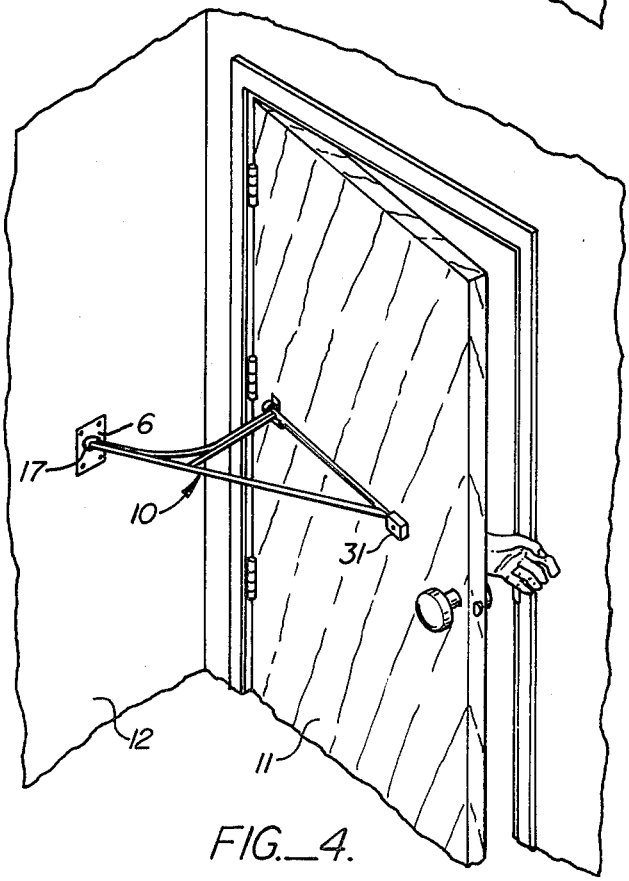
FIG. 4 is a perspective view of another embodiment which allows the door to be placed slightly ajar.
Figure 5:
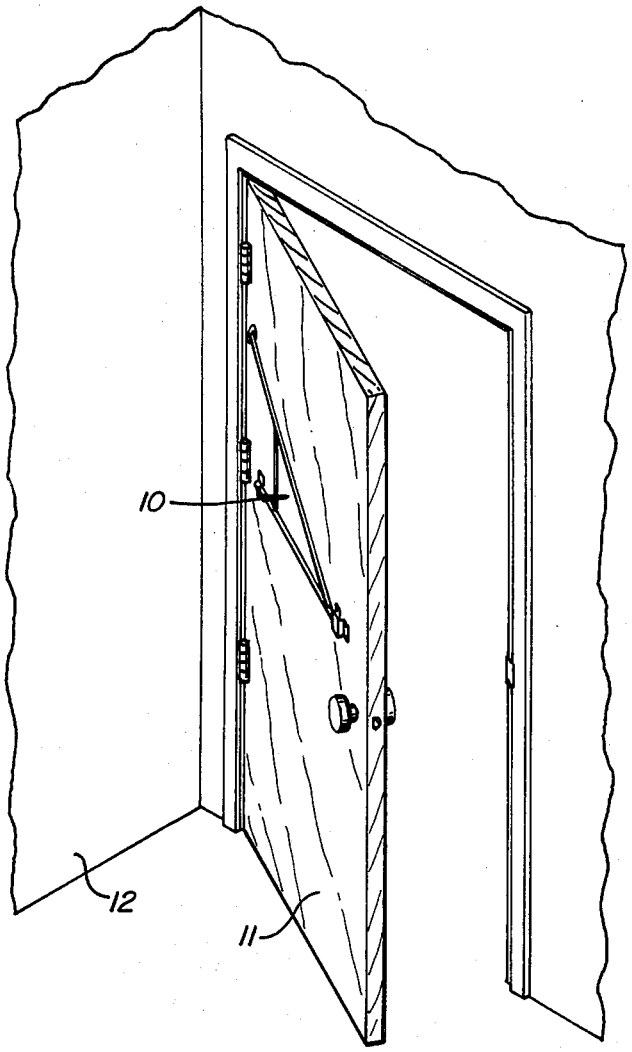
FIG. 5 is a perspective view illustrating the manner in which the device may be rotated to allow unrestricted opening of the door.

The ends of the support rod 13 are connected respectively to a restraining hinge 20 and a free hinge 30. Screws 26 secure the hinges 20, 30 and thereby the door security device 10, to a door 11 (FIGS. 3–5).

Figure 2B:
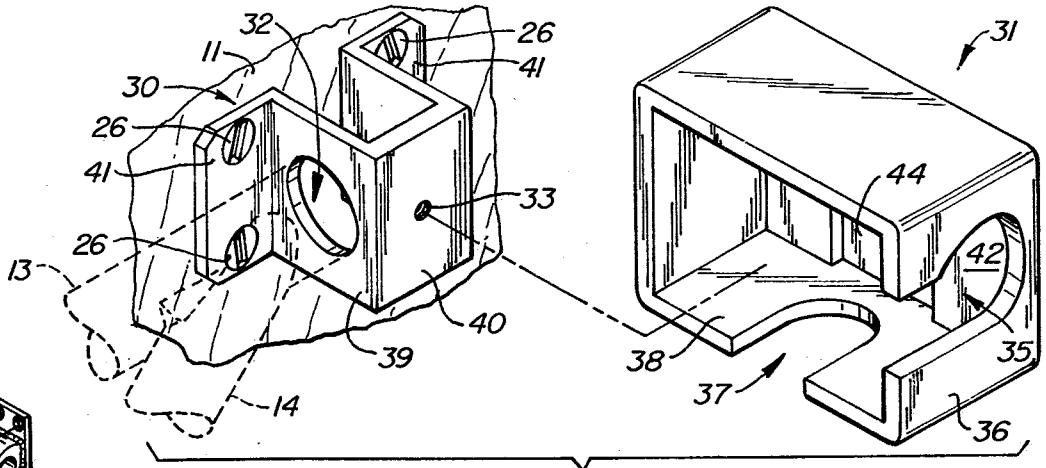
FIG. 2*b* is an exploded perspective view of a preferred embodiment of the free hinge.
Figure 2A:
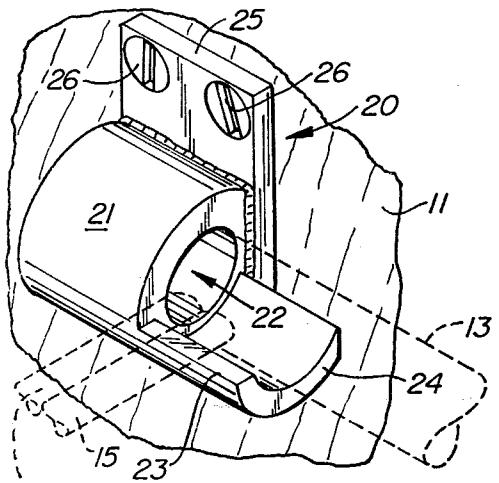
FIG. 2*a* is a perspective view of the restraining hinge of a preferred embodiment of the present invention.

FIG. 2*a* is a perspective view of a preferred embodiment of a restraining hinge 20. The restraining hinge 20 comprises a rectangular hinge plate 25 rigidly connected to a cylinder 21 containing a cylindrical socket 22 adapted to receive an end of the support rod 13. The end of the support rod 13 has a diameter corresponding to the internal diameter of the cylindrical socket 22. A semi-cylindrical member 24 having a planar restraining lip 23 projects outwardly from the cylinder 21. The plane of the restraining lip 23 is normal to the plane of the hinge plate 25. When the end of the support rod 13 which is connected to the spacing rod 15 and to the reinforcing member 16 is inserted into the cylindrical socket 22 of the restraining hinge 20 in the manner shown in phantom perspective in FIG. 2*a*, the spacing rod 15 and the reinforcing member 16 engage the restraining lip 23 and hold the door security device 10 in a plane perpendicular to the plane of the door 11. The restraining hinge 20 also allows the door security device 10 to be rotated upwardly to lie in a plane parallel to the plane of the door 11, as shown in FIG. 5.

FIG. 2*b* is an exploded perspective view of a preferred embodiment of the U-shaped free hinge 30 connected to the other end of the door security device 10, shown in phantom perspective. Rectangular hinge plates 41 are connected at right angles to the ends of the U-shaped free hinge 30 to enable the hinge 30 to be secured to a door 11 by means of screws 26. A rectangular side plate 39, forming one leg of the "U", contains a cylindrical socket 32 adapted to receive the end of the support rod 13 which is directly connected to the stop rod 14 and which has a diameter corresponding to the diameter of the cylindrical socket 32. The rectangular front plate 40, forming the bottom of the "U", contains a threaded screw socket for attaching a hinge cover 31 to the free hinge 30. The hinge cover 31 prevents removal of the free hinge 30 or other tampering with the door security device 10 by a person located outside of the door 11 when the device 10 is in the restraining position shown generally in FIG. 4.

Hinge cover 31 is basically a five-sided cubicle box. One rectangular side plate 36 of the hinge cover 31 contains a P-shaped slot 35 which permits free rotation of the support rod 13 and the stop rod 14 when the hinge cover 31 is placed over the free hinge 30. The rectangular bottom plate 38 of the hinge cover 31 has a semi-ovally shaped slot 37 which permits access to the cylindrical socket 32 for purposes of periodic lubrication. The hinge cover 31 is secured to the free hinge 30 by means of a screw 34 which passes through a hole in the rectangular top plate 42 of the hinge cover 31 and is threaded into the screw socket 33 in the front plate 40 of the hinge 30. The rectangular front plate 40 of the free hinge 30 fits into a correspondingly rectangularly shaped cavity 44 in the inner surface of the top plate 42 of the hinge cover 31 and further secures the hinge cover 31 to the free hinge 30.

FIGS. 3 and 4 illustrate the manner in which a door security device 10 prevents opening from the outside of a hinged door 11 situate adjacent and normal to a wall 12. In use, a force applied to the door 11 is transferred to the wall 12 through the pressure plate 17 via the stop rod 14 and by the spacing rod 15 in conjunction with the reinforcing member 16.

FIG. 3 illustrates an embodiment of the device 10 in which the length of the stop rod 14 is equal to the distance from the closed door 11 to the wall 12, measured along the line of the stop rod 14 when the device 10 is engaged in a plane perpendicuar to the plane of the door 11. In this manner, all opening movement of the door 11 is prevented. In the embodiment shown in FIG. 3, the reinforcing member 16 is omitted.

FIG. 4 illustrates the preferred embodiment of the door security device 10 of the present invention, in which the length of the stop rod 14 is about one to four inches shorter than the distance from the closed door 11 to the wall 12, measured along the line of the stop rod 14 when the security device 10 is in the engaged position. In this embodiment, the doorstop 10 does not engage the wall 12 with the pressure plate 17 until the door 11 has been placed sightly ajar. The advantage of the embodiment of the present invention shown in FIG. 4 is that the door may be placed slightly ajar to obtain a view of the outside e.g., to identify a caller, while retaining the ability for the device 10 to prevent the door 11 from then being opened by unexpected intruders.

In this embodiment, the hinge cover 31 is utilized to prevent the removal of the hinge 30 or other tampering with the device 10 by a would-be intruder. The advantage of the embodiment shown in FIG. 3 is that access through burglary tools designed for manipulating the security device 10 is minimized and the ability to puncture the wall 12 with the stop rod 14 through repeated short hammer-like blows is eliminated. The potential for this type of failure in the preferred embodiment may be minimized by securing a reinforcing wall plate 6 to the wall 12 in the manner shown in FIG. 4.

FIG. 5 is a perspective view of the door security device 10 illustrating the manner in which the door 11 may be freely opened from either side when the device 10 is rotated to lie in a plane parallel to the plane of the door 11. In this position, the device 10 does not engage the wall 12 even when the door 11 is opened to its maximum extent.

While the above provides a full and complete disclosure of the preferred embodiments of this invention, various modifications, alternate constructions, and equivalents may be employed without departing from the true spirit and scope of the invention. For example, provision may be made for a door 11 located at an angle other than a right angle to a wall 12 by adjusting the length of the stop rod or the position of the hinges. Other types of hinges 20, 30 and various shapes of rods 13, 14, 15 could be employed. Therefore, the above description and the accompanying illustrations should not be construed as limiting the scope of the invention which is defined by the appended claims.

What is claimed is:

1. A door security device for use with a door mounted transverse to an adjacent wall comprising:

an elongate stop rod having inner and outer ends, said outer end adapted to engaged the wall;

a first hinge means for pivotally mounting said inner end to said door;

an elongate spacing rod having first and second ends and attached at said first end to an intermediate position along said stop rod; and a second hinge means, horizontally aligned with said first hinge means, for pivotally mounting said second end of said spacing rod to said door, said second hinge means including means for permitting the movement of said spacing rod and stop rod therewith between a first position parallel to the door and a second position generally perpendicular to the door and also including means for preventing the movement of said stop rod past said second position.

2. A door security device for preventing opening from the outside of a hinged door adjacent and normal to a wall, comprising:

an elongate support rod having its opposite ends rotatably connected to the door;

an elongate stop rod rigidly secured at one end to the support rod at an acute angle, adapted at its free end to engage the wall;

a spacing rod rigidly secured at its first end to the support rod and rigidly secured at its other end to the stop rod;

whereby unrestricted opening of the door from either side of the door is allowed when the device is rotated to lie in a first position in a plane parallel to the door; and whereby opening of the door from the outside is prevented by the force of the free end of the stop rod against the wall and the force against the door of the end of the support rod to which the stop rod is secured when the device is rotated about the axis of the support rod to lie in a second position in a plane normal to the door.

3. A door security device for preventing opening from the outside of a hinged door adjacent and normal to a wall, comprising:

a pair of hinges;

an elongate support rod rotatably connected at its ends by the pair of hinges to the inside of the door which swings upon opening toward said wall, the support rod positioned parallel to the top edge of the door;

an elongate stop rod having one end rigidly secured to the support rod near the end of the support rod furthest from the wall, and having its other free end extending outwardly toward the wall at an acute angle to the support rod;

an elongate spacing rod rigidly secured at a right angle to the support rod near the end of the support rod closest to the wall and rigidly secured to the stop rod between the ends of the stop rod, the three rods forming a triangle between their points of connection;

the hinges providing movement of the device from a first position in a plane parallel to the door to a second position in a plane normal to the door;

a pressure plate secured to the free end of the stop rod so that the pressure plate is substantially parallel to the wall when the device is in the second position;

whereby unrestricted opening of the door is allowed when the device is in the first position; and whereby the force of the pressure plate against the wall and the force of the secured end of the stop rod against the door prevents opening of the door from the outside when the device is in the second position.

4. The door security device of claims 2 or 3, wherein:

the length of the stop rod is several inches shorter than the distance from the closed door to the wall, measured along the line of the stop rod when the device is in the second position;

whereby the device in its second position engages the wall after the door is placed slightly ajar, preventing the door from being opened from the outside and allowing a view of the outside of the door from the inside.

5. The door security device of claims 2 or 3, wherein:

the length of the stop rod is equal to the distance from the closed door to the wall, measured along the line of the stop rod when the device is in the second position;

whereby the device in its second position engages the wall when the door is closed, preventing the door from being placed ajar and from being opened from the outside.

6. The door security device of claims 2 or 3, further comprising:

means for maintaining the device in the second position until it is desired to move the doorstop to the first position.

7. The door security device of claim 6, wherein:

the maintaining means is a restraining lip on the hinge nearest the wall which engages the spacing rod.

8. The door security device of claim 3, further comprising:

means for protecting the device from removal or rotation by a person located outside the door when the device is in the second position.

9. The door security device of claim 8, wherein the protecting means is a cover enclosing the hinge furthest from the wall.

* * * * *